United States Patent [19]

Manion

[11] Patent Number: 4,772,016

[45] Date of Patent: Sep. 20, 1988

[54] EXERCISE DEVICE

[76] Inventor: Thomas R. Manion, 8315 Tommy Dr., San Diego, Calif. 92119

[21] Appl. No.: 75,144

[22] Filed: Jul. 20, 1987

[51] Int. Cl.[4] ..... A63B 21/00

[52] U.S. Cl. ..... 272/130; 272/DIG. 1; 272/DIG. 5

[58] Field of Search ..... 272/67, 68, 93, 130, 272/137, 135, DIG. 1; 73/379; 251/122

[56] References Cited

U.S. PATENT DOCUMENTS

| | | | |
|---|---|---|---|
| D. 208,787 | 10/1967 | Prescott | 272/137 |
| 767,008 | 8/1904 | Pelletier et al. | 272/130 |
| 1,707,449 | 4/1929 | Rodale | 272/130 |
| 2,118,013 | 5/1938 | Matthews et al. | 251/122 |
| 2,806,699 | 9/1957 | Spooner | 272/68 |
| 2,825,563 | 3/1958 | Lawton | 272/130 |
| 3,174,343 | 3/1965 | Kasulis | 272/130 |
| 3,228,655 | 1/1966 | Weise | 251/122 |
| 3,638,941 | 2/1972 | Kulkens | 272/130 |
| 3,702,188 | 11/1972 | Phillips et al. | 272/130 |
| 4,606,266 | 8/1986 | Hyman, Sr. | 272/96 |

*Primary Examiner*—Richard J. Apley
*Assistant Examiner*—J. Welsh
*Attorney, Agent, or Firm*—Frank D. Gilliam

[57] ABSTRACT

An exercise comprising a pair of arms pivotably connected to each other at one end and a pneumatic pump connected between and activated by relative arm movement. The pump comprises a cylinder pivotably connected to one arm and a rod fixedly or pivotably connected to the other arm. The rod carries a piston projecting into the aforementioned cylinder. The closed end of the cylinder includes an infinately adjustable air release valve for controlled releasing of compressed air from the closed end of the cylinder during user pivoting together of the distal ends of the arms. Resistance to relative movement of the arms together by the user is selected according to user desired by adjustment of the release value. The adjustable valve has an infinite number positions between fully closed to fully open.

9 Claims, 1 Drawing Sheet

EXERCISE DEVICE

BACKGROUND OF THE INVENTION

1. Field of the Invention

An exercising device for the upper body of the user, and more particularly a pneumatic resistance exercise device with the resistance infinitely variable between release valve fully open and fully closed adjustments.

2. Description of the prior art

U.S. Pat. No. 3,174,343 issued to inventor A.S. Kasulis teaches a pneumatic exercise device in which the resistance of relative movement of the opposing handles is controlled by the speed of movement of the opposing handles toward each other.

U.S. Pat. No. 4,290,599 issued to inventor Isaac Berger teaches a pneumatic exercise device with selectable discrete user resistance settings by relative rotation of the operation handles. The resistance of movement is determined by selecting the number or size of air escape apertures. The sizes and positions of the apertures are predetermined.

U.S. Pat. No. 4,601,467 issued to inventor William Gvoich teaches a valve module for use in and as a pneumatic exerciser. The resistance to the user of the device varies as the device is actuated. The amount of resistance at any user position is predetermined and non-adjustable.

None of the above referenced devices provide the user with a means for selecting a specific operational resistance best suited for his purpose or ability through an infinite number of resistance capabilities of the exercise device.

Because of the ever present awareness of the desirability of physical fitness, there is a continuing need for efficient, low cost exercising equipment.

SUMMARY OF THE INVENTION

Accordingly, it is an object of the present invention to at least partially overcome disadvantages of the prior art by providing a pneumatic exercising device with operating resistance which is infinitely variable through a predetermined range of operating resistances.

A further object of the present invention is to provide an upper body exercising device which includes a user adjustment for selecting a specific user resistance from a range of user selectable resistances.

A still further object of the present invention is to provide an exercising device of the present type that is simple and economical in its construction.

While several objects of the invention have been set forth, other objects, user and advantages will become more apparent as the nature of the present invention becomes more fully disclosed, including its novel construction, combination and arrangement of its several parts shown in the illustration and described in the detailed description to follow.

DETAILED DESCRIPTION OF THE PREFERRED EMBODIMENT

Figure 1:
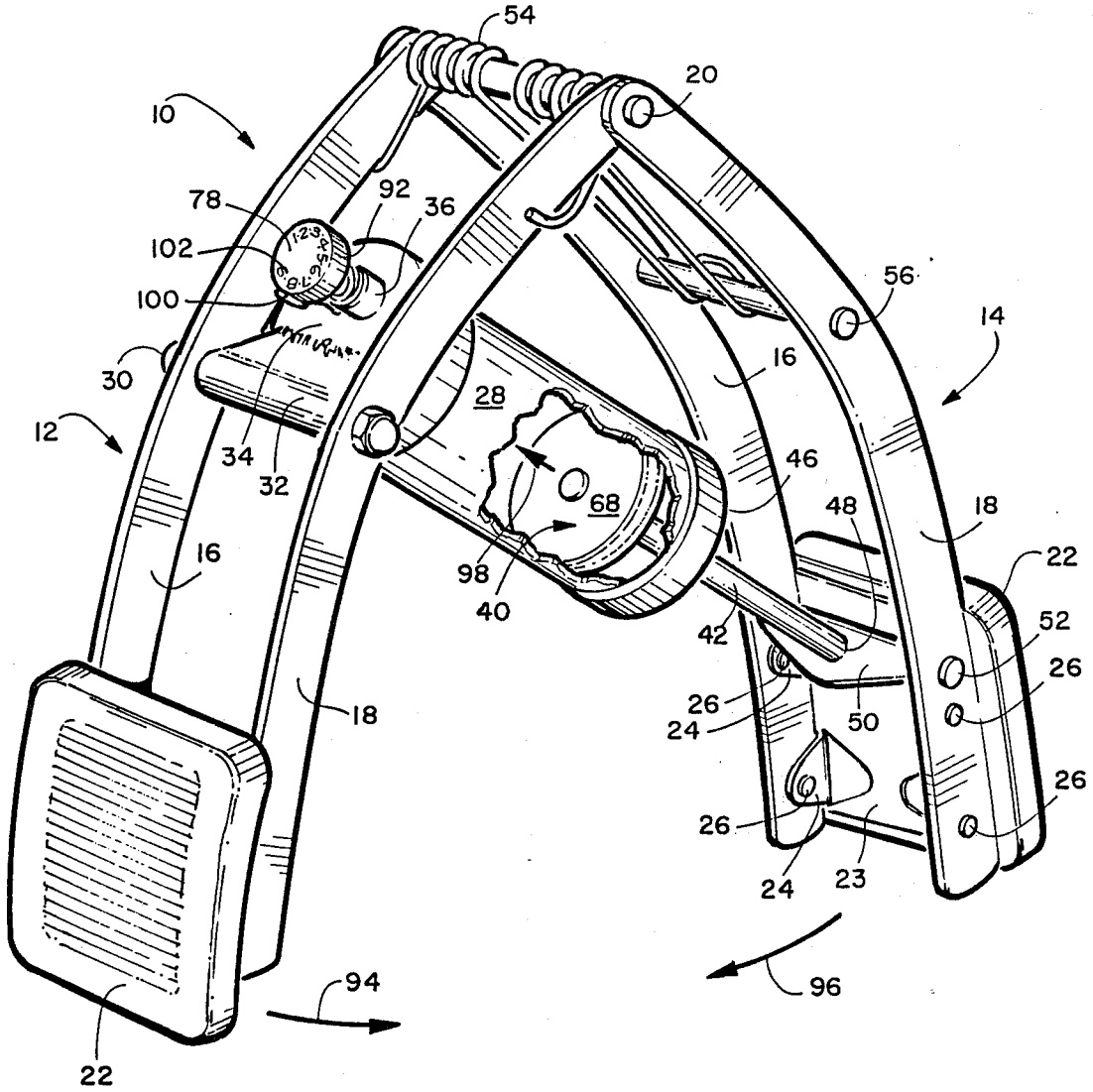
FIG. 1 is a perspective showing of the exercising device of the invention.

Referring now to the Drawing Figures, FIG. 1 is a perspective showing of the exercise device 10 of the present invention. The exercise device 10 comprises a pair of pivotly attached arched actuating arms 12 and 14. Each arm 12 and 14 have a pair of arm members 16 and 18.

The upper end of the arm members 16 and 18 are pivotly connected together by a pivot pin 20.

The distal ends of the arms 12 and 14 include a resilient pad 22. The pads are connected to the arm members 16 and 18 on their respective ends by means of brackets 24, two of which are shown. Each resilient pad 22 is attached to the arm members via a resilient pad mounting plate 23 by a suitable number of brackets 24. The brackets 24 are attached to the arm members and the mounting plate by any convenient fastening means 26. Rivets are shown as an example of the fastening means 26. The resilient pad mounting plate 23 is adhesively attached to the under surface of the resilient pad 22 by any suitable adhesive means.

Connected at an angle between the arm members 16 and 18 of arm 12 is a pneumatic cylinder 28. The connection of the pneumatic cylinder to the arm 12 is by means of a pin 30 shown as a bolt and nut combination the bolt passes through a tubular sleeve 32 attached to the end surface 34 of the cylinder 28 at a location intermediate the ends of member 12 and slightly closer to the arm 12 and 14 pivotal connection. The pin 30 acts as a pivot for the rotation or pivotal action of the cylinder 28 herein after discussed in more detail.

Figure 3:
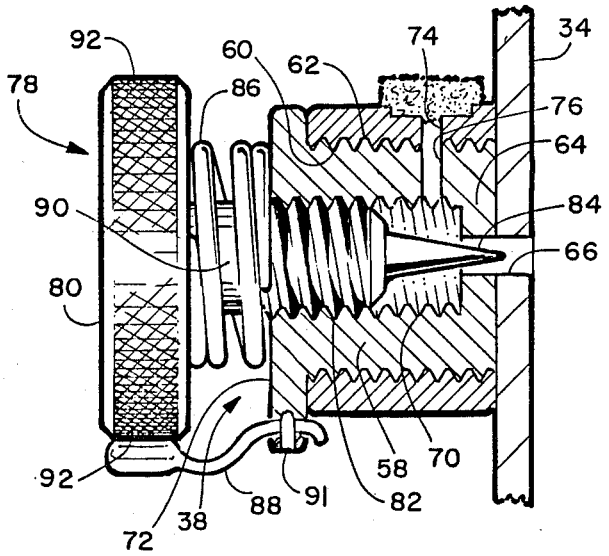
FIG. 3 is a cutaway view of the air release valve.

Also, located on end 34 of the cylinder is a boss 36 which passes through cylinder end wall 34 into the upper end of the cylinder and is secured thereto in a fixed pressure sealed relationship. A pressure release, valve 38, a description of which will be discussed in detail under the description of FIG. 3, is threadedly engaged to the boss 36.

Figure 2:
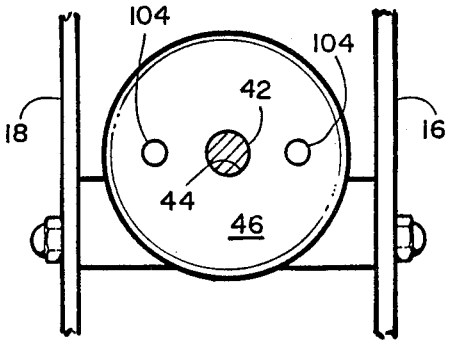
FIG. 2 is a view taken along line 2—2 of FIG. 1.

The cylinder 28 has a hollow central portion which receives a translatable piston 40 therein. A connecting rod 42 is fixedly secured to the center of the piston and extends through a central aperture 44 in the cylinder end wall 46 (see FIG. 2). The extended or distal end 48 of the connecting rod 42 is connected between the arm members 16 and 18 of arm 14 in a manner similar to the cylinder end 24 connection to the arm 12. The distal end 48 of connecting rod 42 is fixedly attached to bracket 50 position near the distal end of arm member 14 and, which includes a bore which a pin 52 passes through and is attached to arm members 16 and 18 allowing bracket 50 to pivot or rotate relative to arm members 16 and 18. If it is desirable to fixedly attach the distal end of the connecting rod 42 to arm members, pin 52 is a bolt which is tightened to prevent rods 42 and arm members 16 and 18 having any relative movement.

The cylinder 28 is angled between arm members 12 and 14 as shown in FIG. 1 and provides a varying degree of resistance between the arm members as they are forced together against the resistance of the cylinder and spring 54 (hereinafter discussed). The angled position allows for a suitable sized cylinder and piston combination to be employed.

A spring 54 is positioned around pin 20 and retained at one side by a pin 56 fixedly connected between arm members 16 and 18 of arm 14 and on the other side by arms members 16 and 18 of arm 12. The tension of the spring 54 causes the arms 12 and 14 to be normally biased apart at their resilient pad distal ends.

Referring now specifically to FIG. 3 which depicts a novel user resistance adjustable valve. The pressure relief valve 38 comprises a bushing 58 which is threaded into internal female threads 60 of boss 36 via male threads 62 on the outer surface of the bushing. The bottom wall 64 of the bushing 58 has a central aperture 66 therebetween which extends into the cylinder 28 between surface 68 of the piston and the cylinder end wall 34 (see FIG. 1). Female threads 70 extend from lip 72 of bushing 58 to the bottom wall 64. An aperture 74 extends through the side wall of boss 36 and is aligned with an aperture or slit 76 through bushing 58.

A central dial knob 78 with an enlarged head 80 and male threads 82 mate with female threads 70 of bushing 58. The central dial knob has a conic tip 84 at the end opposite the enlarged head end 84. When the central dial knob is threaded into the bushing 58, the conic tip 84 extends into aperture 66 an amount depending on the rotational position of the control knob relative to the boss 36. A coil spring 86 is positioned around a central body portion 90 of the dial knob 78 intermediate the enlarged head 80 and the boss lip 72. The spring 86 biases the dial knob away from the boss lip 72 binding the threads 70 and 82 which resists undesired rotation of the dial knob. A leaf spring 88 attached to the lip 72 of the bushing 58 via fastener 91. The leaf spring biases against the outer rough surface 92 of the dial knob 78. The leaf spring 88 adds additional resistance to the undesirable rotation of the dial knob 78.

In operation, the arms 12 and 14 are normally biased apart by spring 54 shown with the piston 40 near cylinder end 46. As the user forces the arms 12 and 14 together against the bias of spring 54 along arrows 94 and 96, the piston travels along the direction of arrow 98. This action causes air trapped between piston surface 68 and cylinder end 34 to compress. The amount of force required by the user to move the arms along arrows 94 and 96 is determined by the position of the conic tip 84 within aperture 66. The position of tip 84 relative to the walls of aperture 66 determines the volume of compressed air that exits aperatures 76 and 74 to the atmosphere. The smaller the passage between the aperture and the conic tip the greater the pressure required by the user to expel a given volume of the compressed air. The pitch of the threads, the angle of the conic tip and the bore of aperture 66 all relate to the finite degree of pressure required to force the arms 12 and 14 together. Obviously, with these elements fixed in dimension, the force required to bring the arms 12 and 14 together can be infinite varied within a predetermined range according to the fixed elements sized between a closed off aperture 66 to a fully opened aperture 66 by rotating the dial knob 78.

The forward edge of the leaf spring 88 has a vertical fixed indicator reference 100 which aligns with movable reference indicator 102 on the front surface adjacent to reference 100. The alignment of the movable reference with the fixed reference indicia provides for an indication of a force setting.

Vent apertures 104 through end 46 of the cylinder allows the air to be drawn in and exit from the cylinder behind surface 68 as the piston is caused to translate in the cylinder pourous material, for example, felt or the like can be fixedly positioned over the outer end of aperture 74 to reduce noise produced by compressed air exiting to the atmosphere therefrom.

The various elements of the device can be constructed of any material suitable for practicing the claimed invention.

Obviously, other refinements and modifications may occur to the skilled artisan without departing from the teachings embraced in this application. Consequently, the appended Claims should be liberally construed, in a manner consistent with the spirit of the invention, and should not be limited to their exact, literal terms.

What is claimed:

1. A pneumatic exercise device comprising:

a first and second accurate handle member pivotly connected together at one end thereof and curved toward each other at their distal ends;

a pneumatic cylinder pivotally connected at a first end thereof to said first handle member;

a piston for sealed translation within said pneumatic cylinder;

a connecting rod attached to said piston at one end thereof, passing through a central aperture in a second end of said pneumatic cylinder remote from said first end and the distal end of said connecting rod being attached to said second handle member, said pneumatic cylinder being angled between said first and second accurate handle members; and an adjustable pressure relief valve extending from within said pneumatic cylinder through said first end thereof, when said first and second handles are forced together at their distal ends from a spaced apart position air is compressed within said pneumatic cylinder by said piston and released according to the setting adjustment of said pressure relieve valve thereby providing a variable resistance against the forcing together of said first and second handles.

2. The invention as defined in claim 1 wherein a spring bias is provided between said first and second handle members to hold said handle members in a normally spaced apart relationship at their distal ends.

3. The invention as defined in claim 1 wherein said first and second handles are symmetrical.

4. The invention as defined in claim 1 where in the outside distal end of said handle members have soft pads attached thereto.

5. The invention as defined in claim 1 wherein said adjustable pressure relief valve includes a base portion with a central elongated port extending within said cylinder, a needle valve threadedly adjustable within said base and a vent opening, said needle valve having a conic tip extending into said central elongated port, the position of of said conic tip wherein said port determining the volume of comprised air flowing from said cylinder through said vent opening.

6. The invention as defined in claim 5 wherein a coil spring is positioned between said base portion and said needle valve for biasing said needle valve away from said base portion for resisting relative rotational movement therebetween.

7. The invention as defined in claim 5 wherein an externally positioned friction-lock means is provided on the side edge of the end of said needle valve remote from said conic tip for maintaining said needle valve at a preselected rotational position relative to said base portion.

8. The invention as defined in claim 5 wherein said vent opening includes a muffler means to dampen the sound of compressed air exiting therefrom.

9. The invention as defined in claim 5 wherein said needle valve opposite said conic tip comprises a knob means with indicia thereon for adjustment of said needle valve to a predetermined volume of compressed air exiting therefrom and for engaging a leaf spring for a friction-lock means for maintaining said knob means and said needle valve in a selected rotational position.

* * * * *